US007488013B2

(12) United States Patent
Urpolahti

(10) Patent No.: US 7,488,013 B2
(45) Date of Patent: Feb. 10, 2009

(54) FOOT BOLT FOR A SLIDING DOOR OR SIMILAR

(76) Inventor: Jouko Urpolahti, Mäntymaantie 1, FI-28560, Pori (FI)

( * ) Notice: Subject to any disclaimer, the term of this patent is extended or adjusted under 35 U.S.C. 154(b) by 0 days.

(21) Appl. No.: 10/582,715

(22) PCT Filed: Sep. 12, 2003

(86) PCT No.: PCT/FI03/00666

§ 371 (c)(1),
(2), (4) Date: Jun. 12, 2006

(87) PCT Pub. No.: WO2005/026482

PCT Pub. Date: Mar. 24, 2005

(65) Prior Publication Data

US 2007/0046034 A1 Mar. 1, 2007

(51) Int. Cl.
*E05C 1/02* (2006.01)
*E05C 1/04* (2006.01)

(52) U.S. Cl. ..... 292/179; 292/145; 292/150; 292/302; 292/DIG. 15; 292/DIG. 46; 52/243.1

(58) Field of Classification Search ..... 52/243.1, 52/241, 64, 29; 292/137, 163, 164, 175, 292/138, 145, 150, 302, DIG. 63, DIG. 46, 292/DIG. 20, DIG. 47, DIG. 15, 179; 49/409; 160/40, 196.1, 199
See application file for complete search history.

(56) References Cited

U.S. PATENT DOCUMENTS

| | | | | | |
|---|---|---|---|---|---|
| 3,768,847 | A | * | 10/1973 | Buck et al. | 292/179 |
| 3,799,593 | A | * | 3/1974 | Dielman | 292/145 |
| 4,601,502 | A | * | 7/1986 | Van Dyke | 292/252 |
| 6,108,989 | A | * | 8/2000 | Kordes et al. | 52/243.1 |

FOREIGN PATENT DOCUMENTS

| | | |
|---|---|---|
| DE | 4428718 | 2/1996 |
| DE | 19634390 | 3/1998 |

* cited by examiner

*Primary Examiner*—Patricia L Engle
*Assistant Examiner*—Alyson M Merlino
(74) *Attorney, Agent, or Firm*—Stites & Harbison PLLC; Douglas E. Jackson

(57) ABSTRACT

A foot bolt (10) of a sideways movable sliding door or a similar element (1-3), includes a part locking the element in the base, such as a pin fitting in the hole in the base. The foot bolt also has a counterpart (9) in the next element movable beside it, in which counterpart the part (13) in the edge of the preceding element can be fitted so that the adjacent elements get sideways interlocked. On moving the elements in the opposite direction, pushing of the last brought element away from the preceding element opens the locking of the preceding element from the base. The pin fitting in the hole in the base is intended to be manually pressed, for instance by the foot, into the hole.

4 Claims, 2 Drawing Sheets

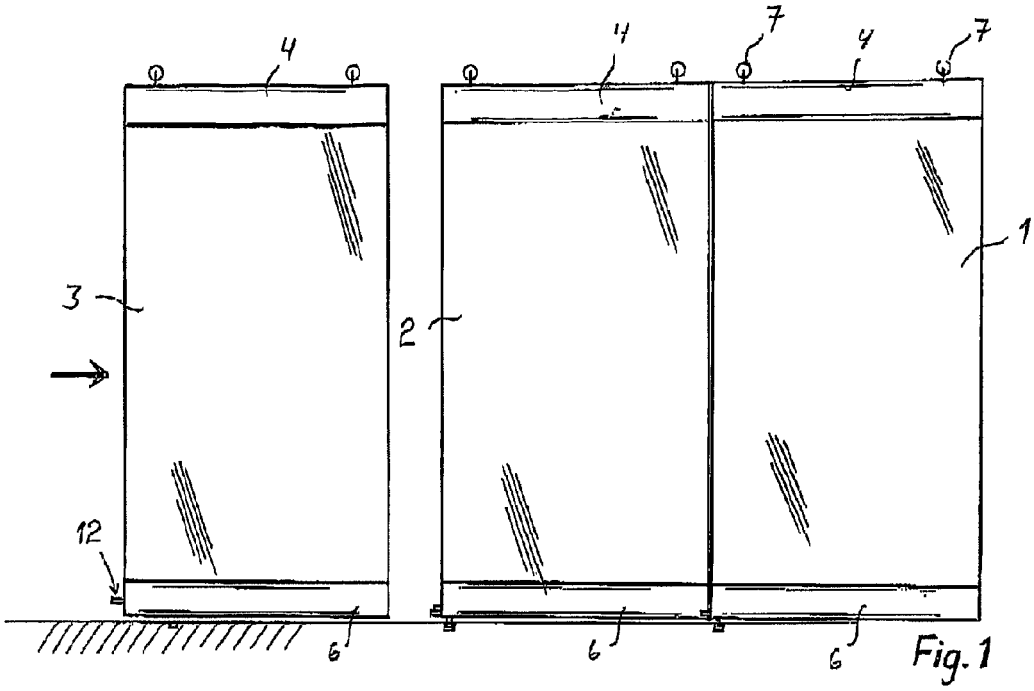
Fig. 1
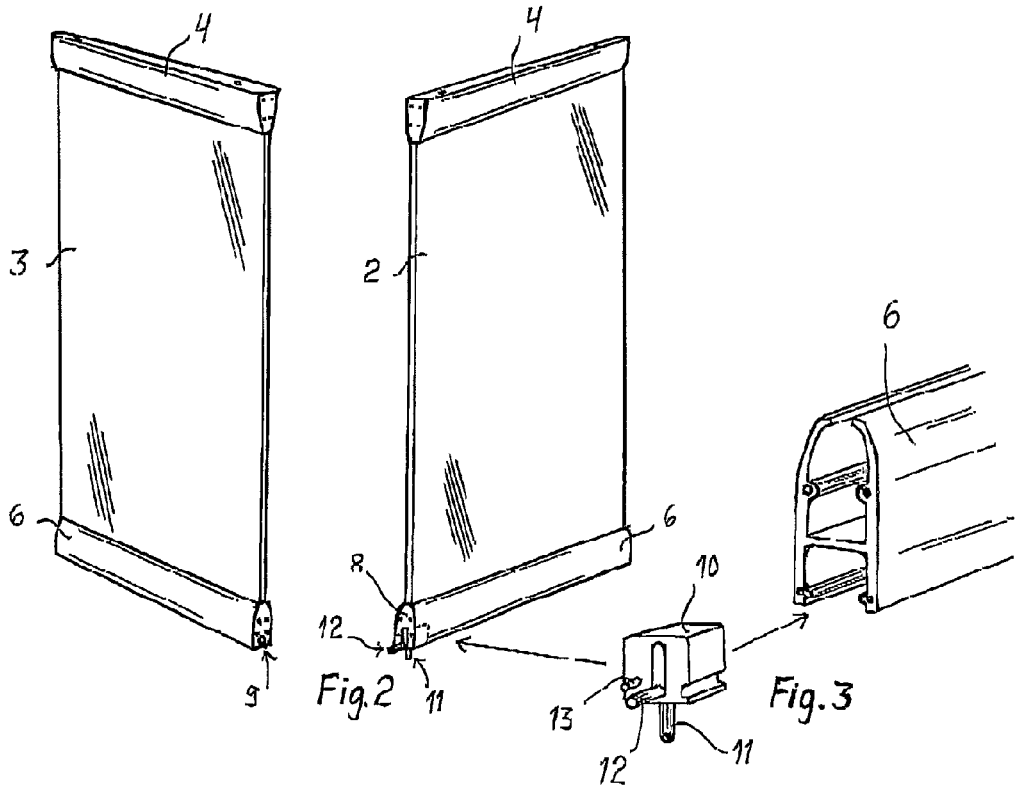
Fig. 2
Fig. 3

FOOT BOLT FOR A SLIDING DOOR OR SIMILAR

The invention relates to a foot bolt for a sideways movable sliding door, a wall, a sliding window or a similar elements. The foot bolt includes a part locking the element in the base, such as a pin fitting in the hole in the base. The foot bolt also includes a counterpart in the next element movable beside it. In the counterpart, the part in the edge of the preceding element can be fitted, so that the adjacent elements get sideways interlocked together. Further, on moving the elements in the opposite direction, pushing of the last brought in element from beside the preceding element opens the locking of the preceding element from the base.

Previously known are foot bolt constructions as described in, among others, U.S. Pat. No. 6,108,989, and DE published applications 4428718 and 19634390. In all of them, an automatic foot bolt is presented which is always placed in the more preceding element in its edge against which the next element is moved. The foot bolt has a pin fitting in the hole in the base, the sliding wall of which pin is moved as the next contact is made by means of different gears that sink down into the hole in the base. The solutions reguire that on moving walls away, the removal of the preceding element releases the foot bolt pin in the next element up from the hole in the base.

Such a solution is easily produced but in practice the solution works only in connection with most accurately controlled elements, for which the holes in the base are in just the right positions according to the elements. In these solutions, when pushing the next element as an extension of the preceding one, locking of the edge of the preceding element takes place only when the next element is pushed into contact. Accordingly, there is then no way to insure that the pin properly takes its place in the hole in the base.

The weakness of these solutions is that on moving tall elements, such as those of 2.5-3 meter height, which are slide suspended only from their upper edge, the elements do not all hang by themselves so accurately to insure that a pin in the bottom edge thereof, for instance with a diameter of about 10 mm, will hit a hole with a diameter of about 15 mm. In spaces where such closing walls are used there are often so much air flows that the elements simply swing. Under those circumstances, it is impossible in the practice for automatic locking of elements to one another to work in the ways corresponding to solutions represented in the publications.

The aim of the invention is to produce a foot bolt, the function of which is reliable, with its locking quickly done and with its opening automatic when it is desired to move the walls. The invention is characterized in that the pin fitting in the hole in the base is manually pressed with the foot into the base hole. In addition, the bolt construction comprises a locking/release pin, which in the first stage is arranged to lock the pressed-down pin in the hole in the base. Directed towards the next element is a bracket of the pin, for which there is in the next element a counter-hole for interlocking with the bracket. Further, there is a locking/release pin arranged to stick out from the element edge so that it can, when the next close element beside the preceding already brought in element, be pushed into a pin releasing position. In pin releasing position, the pin is individually, for instance by a spring, arranged to move up from the hole in the base, when the adjacent element is eventually removed.

The advantage of the foot bolt according to this invention is that when a separate wall is in its turn pushed to the position intended for it, it can be controllably steered to its place and then at the same time it is positioned it can be locked in place by simply stamping the locking pin down. The staying put of the element is easily secured, and the pin position is easily seen to determine whether it has the possibility to get into the hole at the time that locking is desired. In the solution the user need not bend over to effect locking, since locking, that is stamping down the pin, is most suitably done by foot. Then, the next element to be brought into contact lines up with the foot bolt thereof, and so that it opens automatically, when starting to remove elements. The solution according to the invention can be used both for small size elements and especially for large ones.

In the following, the invention is disclosed referring to the enclosed drawings, where:

FIG. 1 shows sliding fit glass elements from the side.

FIG. 2 shows fit glass elements, edge profile and the foot bolt.

FIG. 3 shows an enlarged foot bolt and its insertion into the profiled of the associated bottom edge.

Figure 4:
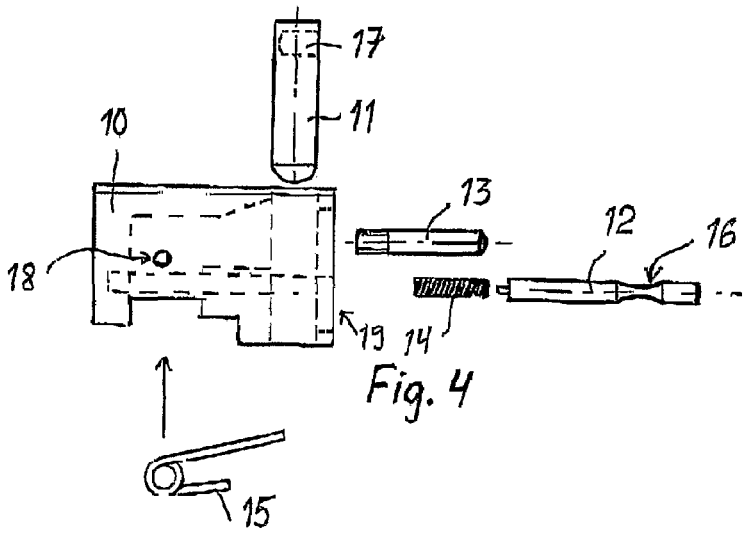
FIG. 4 shows the foot bolt from the side partly broken up.

In FIG. 1, glass sheet elements 1-3 are installed by means of rollers to be moved in the upper fixing rail. By means of elements 1-3, a broad corridor space, for instance, can if necessary be closed. In the bottom edge of each glass sheet 1-3, there are edge strips 4 and 6 made of aluminum. The elements 1-3 are linked in order to form a uniform wall.

In FIG. 2 the elements 1-3 are shown in perspective, whereat also in FIG. 3 the profile form of the bottom edge strip 6 is shown in greater detail. In the shown end of edge strip 6, foot bolt 10 can be fitted. In the other end of the profile form of edge strip 6, foot bolt 10 is also pratially fitted, and in that other end for fitting with the foot bolt 10 there is a profile-locking end piece furnished with a hole 9. When element 3 is moved in contact beside element 2, the pin 12 of foot bolt 10 of element 2 extends into hole 9 in the end of element 3. The downwards pin 11 of foot bolt 10 is positioned in the hole in the bottom of the floor as illustrated also in FIG. 1.

Figure 5:
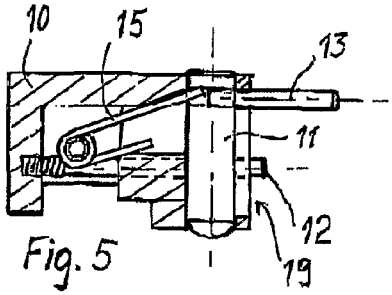
FIG. 5 shows the foot bolt cut with the pin up.
Figure 6:
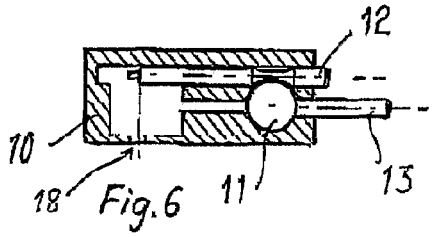
FIG. 6 shows the boot bolt of FIG. 5 cut from above

FIG. 4 shows the foot bolt 10 construction exploded schematically. The upwardly movable locking pin 11 is assembled by being pushed into a receving hole in foot bolt 10 as shown. Then, by use of the oblong hole 19 in the side of the body, the threaded head of the sideways directed bracket 13 is pushed towards the pin 11 and screwed into hole 17 in pin 11. For pin 11, a travel distance is thus determined by the oblong extent of side hole 19. Spring 15 is placed inside body 10, whereat its springback force is used to keep pin 11 in its upper position as shown in FIG. 5. Spring 15 is fitted into its housing by means of a shaft (not shown), which is pushed through hole 18 and then runs through the spring eye of spring 15. There is located in the body of foot bolt 10 a hole for receipt of a locking/release pin 12, hole is located with respect to the receiving hole of pin 11 such that they intersect partly as shown best in figures 6 or 8. Spring 14 is located so as to push pin 12 outwards. Furthermore, pin 12 has a reduced diameter or thinning spot 16, so that when the thinning spot is on the line of,or opposite to, pin 11, pin 11 can move vertically.

Figure 7:
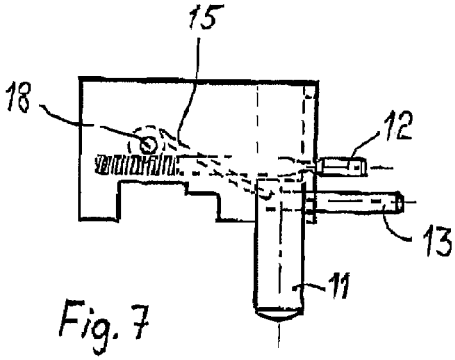
FIG. 7 shows the foot bolt cut with the pin down.
Figure 8:
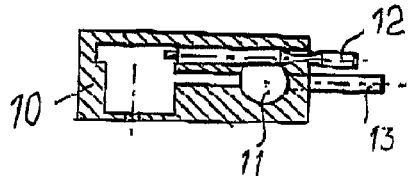
FIG. 8 shows the boot bolt of FIG. 7 cut from above

FIG. 5 is a crosscut view of the body of foot bolt 10. As shown, spring 15 keeps pin 11 up where the thinning spot is on the line of or aligned with pin 11. When the sheet element is moved by pressing it as with a foot to its desired place, in order to hold the sheet elemnet in place it is necessary to lock bracket 13. Bracket 13 is locked when pin 11 gets moved into a lower position in the hole in the base, and when it also remains in the lower position. Since pin 11 has been pressed down so much, locking/releasing pin 12 has, as shown in FIGS. 7 and 8, come out a little from the body of foot bolt 10 as it is pushed by its spring 14. And in this pushed out position of pin 12 the portion of even thickness or greater diameter has thus moved partly over the top of pin 11. That is why pin 11 then remains in lower position.

When the next sheet element is brought closed beside the preceding one, there is, in the edge of the profile of the bottom edge strip 6 of the element to be the brought into contact a cover with a hole 9. The cover hits locking/releasing pin 12 and pushes it into the body of foot bolt 10, while bracket 13 is received into position in cover hole 9. When cover hole 9 is loose or slightly oblong lengthwise, this allows bracket 13 and hence pin 11 to move up a little by the force of spring 15. Then, when pin 12 is pushed by the cover so that thinning point 16 of pin 12 is now on the line of pin11, pin 11 moves up crosswise to thinning point 16 of pin 12 (since oblong hole 9 allows such raising) so much so that pin 12 gets locked into a position that allows releases o pin 11. However, bracket 13 is still held against further upward movement in hole 9 and pin 11 is still in the hole in the base, whereby the element is locked to the base at the foot bolt 10 in both the sideways and in the moving direction; and even the other end of the adjacent element's lower edge is locked sideways by receipt of pin 13 in the cover hole 9. The profile ends of the lower edge 6 of each element thus have a hole 9 in the cover in one end and a foot bolt 10 in other end. Foot bolt 10 is most suitably formed to be pushed directly into profile 6 as shown in FIG. 3.

When elements 1-3 are moved away in the opposite direction, the movement of the first element causes that foot bolt 11 of the next element to move up by force of the spring 15 immediately. Thus the next element is automatically unlocked and hence it can be moved away as the other ones are left behind.

By the foot bolt solution of the present invention, the moving and locking of elements to their places can be reliably carried out, since the element is handled and controlled manually till the locking occurs. Locking can in no way be operated from the outside of the wall, and no steering rails are need for the elements, only a series of holes on the line desired and at proper distances from one and other.

The invention claimed is:

1. A foot bolt system for locking in place a plurality of adjacent sideways movable, sliding, planar elements, the foot bolt system comprising:

a counter hole in a next planar element, which is movable to be beside a preceding planar element, and a foot bolt in the preceding planar element including a) a base pin fitting down in a hole in a base which is used for locking the preceding planar element relative to the base, b) a bracket in an edge of the preceding planar element which is connected to the base pin so that, a downwards movement of the bracket moves the base pin down into the hole in the base and locates the bracket in a down position in order to be received in the counter hole, the preceding and next planar elements are sideways interlocked when the bracket is in the down position and is received in the counter hole after movement of the base pin into the hole in the base, whereby the bracket is held against upwards movement from the down position by engagement with the counter hole, and on moving the next planar element away from beside the preceding planar element, the counter hole no longer restrains the bracket in the down position and hence against upwards movement, and likewise no longer restrains the base pin against upwards movement from down in the hole in the base, c) a locking/releasing pin, which in a first locking position, i) locks the base pin down in the hole in the base with the bracket thus located in the down position to be received in the counter hole of the next planar element, and ii) sticks out from the preceding planar element edge, and in a second releasing position, when the next planar element is brought close beside the preceding planar element so that the next planar element pushes the locking/releasing pin inwards from the preceding planar element edge, releases the base pin from being locked down in the hole even while the bracket in the down position and received in the counter hole prevents the base pin from moving upwards, and d) a member which, when the next planar element is removed and the locking/releasing pin is in the second releasing position, i) moves the base pin up from down in the hole in the base and ii) likewise moves the bracket upwards from the down position.

2. A foot bolt system according to claim 1, wherein the counter hole in the next planar element which receives the bracket connected to the base pin of the preceding planar element allows a controlled slight upward movement of the bracket and base pin to a maintaining position when the locking/releasing pin moves to the second releasing position, the maintaining position of the base pin maintaining the base pin in the hole in the base until the next planar element is removed, so that the bracket is released from being held in the down position by the counter hole and hence the base pin moves up from the hole in the base.

3. A foot bolt system according to claim 1:

wherein the locking/releasing pin has an axial path and the base pin has an axial path which is arranged to partly cut the axial path of the base pin; and wherein the base pin has a thinning which is outside the axial path of the base pin when the locking/releasing pin is in the releasing position.

4. A foot bolt system according to claim 1, wherein the base pin, the locking/releasing pin, and the bracket of the foot bolt are located adjacent the edge of the preceding planar element.

* * * * *